US007182505B2

(12) United States Patent
Huckby

(10) Patent No.: US 7,182,505 B2
(45) Date of Patent: Feb. 27, 2007

(54) APPARATUS AND METHOD FOR MIXING A FLUID DISPERSION DISPOSED IN A CONTAINER HAVING EITHER A CYLINDRICAL OR A SQUARE SHAPE

(75) Inventor: Dwight R. Huckby, Brookpark, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 0 days.

(21) Appl. No.: 10/435,693

(22) Filed: May 9, 2003

(65) Prior Publication Data

US 2003/0214878 A1 Nov. 20, 2003

Related U.S. Application Data

(60) Provisional application No. 60/380,390, filed on May 13, 2002.

(51) Int. Cl.
*B01F 9/00* (2006.01)

(52) U.S. Cl. ..... 366/217; 366/218

(58) Field of Classification Search ..... 366/217, 366/219, 209, 208

See application file for complete search history.

(56) References Cited

U.S. PATENT DOCUMENTS

| | | | | |
|---|---|---|---|---|
| 285,174 | A * | 9/1883 | Sterns | 366/217 |
| 1,292,127 | A * | 1/1919 | Stevens | 366/217 |
| 1,301,536 | A | 4/1919 | Bee | |
| 1,774,257 | A * | 8/1930 | English | 366/217 |
| 2,006,451 | A | 7/1935 | Glidden | 91/57 |
| 2,022,527 | A * | 11/1935 | Schletz | 366/211 |
| 2,843,302 | A | 7/1958 | Bandy | 224/45 |
| 2,868,411 | A | 1/1959 | Kesselman | 220/85 |
| 2,894,309 | A * | 7/1959 | Brzowski | 366/211 |
| 3,301,534 | A | 1/1967 | Orser | |
| 3,421,053 | A | 1/1969 | Rinard et al. | 317/157.5 |
| 3,503,592 | A | 3/1970 | Taylor, Sr. et al. | 259/91 |
| D217,231 | S | 4/1970 | Pashman | D9/239 |
| 3,542,344 | A | 11/1970 | Oberhauser | 259/75 |
| 3,583,623 | A | 6/1971 | Golner et al. | 229/2.5 |
| 3,643,671 | A | 2/1972 | Henninges et al. | 134/118 |
| 3,679,184 | A * | 7/1972 | Woodham et al. | 366/219 |
| 3,778,033 | A * | 12/1973 | Pullman | 366/219 |
| 3,885,357 | A | 5/1975 | Hoyt | 51/163 |

(Continued)

FOREIGN PATENT DOCUMENTS

DE 94 00 396.3 4/1994

(Continued)

OTHER PUBLICATIONS

Database WPI, Section CH, Week 198350, Derwent Publications Ltd., London, GB; Class J02, AN 1983-843533, XP002228265 & SU 997 778 A (Gonchar V P), Feb. 23, 1983 abstract.

(Continued)

*Primary Examiner*—Tony G. Soohoo
(74) *Attorney, Agent, or Firm*—Arthi K. Tirey; Robert E. McDonald; Paul R. Katterle

(57) ABSTRACT

Apparatus and method for mixing a fluid dispersion disposed in a container having either a cylindrical or a square shape.

9 Claims, 9 Drawing Sheets

U.S. PATENT DOCUMENTS

| | | | | | |
|---|---|---|---|---|---|
| 4,004,783 | A | | 1/1977 | Wilson | 259/72 |
| 4,077,613 | A | | 3/1978 | Wilson | 366/213 |
| 4,100,616 | A | | 7/1978 | Wilson | 366/213 |
| 4,134,689 | A | | 1/1979 | Ahrenskou-Sorensen | 366/110 |
| 4,183,677 | A | | 1/1980 | de Bruyne | 366/209 |
| 4,227,625 | A | | 10/1980 | Underwood | 220/307 |
| 4,235,553 | A | | 11/1980 | Gall | 366/208 |
| 4,265,548 | A | | 5/1981 | Hall | 366/208 |
| 4,329,068 | A | | 5/1982 | Neuner et al. | 366/214 |
| 4,491,307 | A | | 1/1985 | Ellefson | 269/55 |
| 4,497,581 | A | | 2/1985 | Miller | 366/208 |
| D279,763 | S | | 7/1985 | Hestehave et al. | D9/375 |
| 4,530,442 | A | | 7/1985 | Vogel, Jr. et al. | 220/354 |
| 4,586,292 | A | * | 5/1986 | Carroll et al. | 366/219 |
| 4,728,197 | A | * | 3/1988 | Reinhard | 366/219 |
| 4,842,415 | A | | 6/1989 | Cane et al. | 366/110 |
| D323,115 | S | | 1/1992 | Kelsey | D9/423 |
| 5,167,448 | A | | 12/1992 | Herold et al. | 366/213 |
| 5,197,802 | A | | 3/1993 | Miller et al. | 366/217 |
| 5,268,620 | A | | 12/1993 | Hellenberg | 318/114 |
| 5,269,438 | A | | 12/1993 | Kelsey | 220/766 |
| 5,320,248 | A | | 6/1994 | Jamieson, III | 220/669 |
| 5,352,037 | A | * | 10/1994 | Jouvin | 366/219 |
| 5,437,505 | A | | 8/1995 | Sanders et al. | 366/209 |
| D362,180 | S | | 9/1995 | Haines | D9/424 |
| 5,462,353 | A | | 10/1995 | Gatlin | 366/209 |
| D372,197 | S | | 7/1996 | Gough | D9/532 |
| 5,551,779 | A | | 9/1996 | Gantner et al. | 366/217 |
| 5,711,601 | A | | 1/1998 | Thomas et al. | 366/209 |
| 5,746,510 | A | * | 5/1998 | Mark et al. | 366/217 |
| 5,788,371 | A | | 8/1998 | Neri et al. | 366/217 |
| 5,855,304 | A | | 1/1999 | Dean et al. | 222/481 |
| 5,906,433 | A | | 5/1999 | Mazzalveri | 366/209 |
| 5,906,434 | A | | 5/1999 | Berrios | 366/213 |
| 6,059,138 | A | | 5/2000 | Labruyere | 220/574 |
| 6,193,410 | B1 | | 2/2001 | Puckett, II | 366/348 |
| 6,365,115 | B1 | | 4/2002 | Wood | 422/292 |
| 6,530,500 | B2 | | 3/2003 | Bravo et al. | 222/143 |
| 6,709,151 | B2 | * | 3/2004 | Schmidt | 366/219 |
| 6,767,125 | B2 | | 7/2004 | Midas et al. | 366/209 |
| 6,767,126 | B2 | | 7/2004 | Miller | 366/217 |
| 6,817,751 | B2 | * | 11/2004 | Huckby et al. | 366/217 |
| 2001/0025865 | A1 | | 10/2001 | Bravo et al. | 222/465.1 |
| 2002/0195471 | A1 | | 12/2002 | Nottingham et al. | 222/570 |
| 2003/0179646 | A1 | * | 9/2003 | Miller | 366/217 |

FOREIGN PATENT DOCUMENTS

| | | |
|---|---|---|
| FR | 2 537 453 A1 | 12/1982 |
| GB | 1310655 | 3/1973 |
| JP | 61-161128 | 7/1986 |
| JP | 8-38871 | 2/1996 |
| SU | 997778 | 2/1983 |

OTHER PUBLICATIONS

Patent Abstracts of Japan, vol. 010, No. 366 (C-390), Dec. 6, 1986 & JP 61 161128 A (Internatl Paint KK), Jul. 21, 1986 abstract.

* cited by examiner

APPARATUS AND METHOD FOR MIXING A FLUID DISPERSION DISPOSED IN A CONTAINER HAVING EITHER A CYLINDRICAL OR A SQUARE SHAPE

CROSS-REFERENCE TO RELATED APPLICATION

This application claims the benefit of U.S. provisional patent application No. 60/380,390 filed on May 13, 2002, the entirety of which is hereby incorporated by reference.

BACKGROUND OF THE INVENTION

The present invention relates to the mixing of fluid dispersions and more specifically to apparatus and methods for mixing paint disposed in a container having either a cylindrical or a square shape.

As is well known, solids in fluid dispersions, such as paint, tend to settle in a downward direction through the force of gravity. Fluid dispersions disposed in containers for commercial sale are typically mixed in the containers before they are used by the purchasers. Many fluid dispersions can be facilely mixed in a container by manually shaking the container. Other fluid dispersions, however, such as paint, are more difficult to manually mix in a container and, thus, are often mixed in the container using a machine that shakes, rotates, vibrates or otherwise moves the container.

A variety of different types of mixing machines are known for mixing fluid dispersions disposed in containers. Examples of conventional mixing machines include those disclosed in U.S. Pat. No. 3,542,344 to Oberhauser, U.S. Pat. No. 4,235,553 to Gall, and U.S. Pat. No. 4,497,581 to Miller, all of which are hereby incorporated by reference. These and most other conventional mixing machines can only accommodate cylindrical containers. Such mixing machines cannot properly accommodate generally square containers. It has been proposed, however, to package fluid dispersions, such as paint, in generally square containers. An example of one such container is disclosed in U.S. Patent Application Publication No. US2001/0025865A1 to Bravo et al., which is hereby incorporated by reference. Accordingly, there is a need in the art for an apparatus and method for mixing fluid dispersions disposed in generally square containers as well as cylindrical containers. The present invention is directed to such an apparatus and method.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
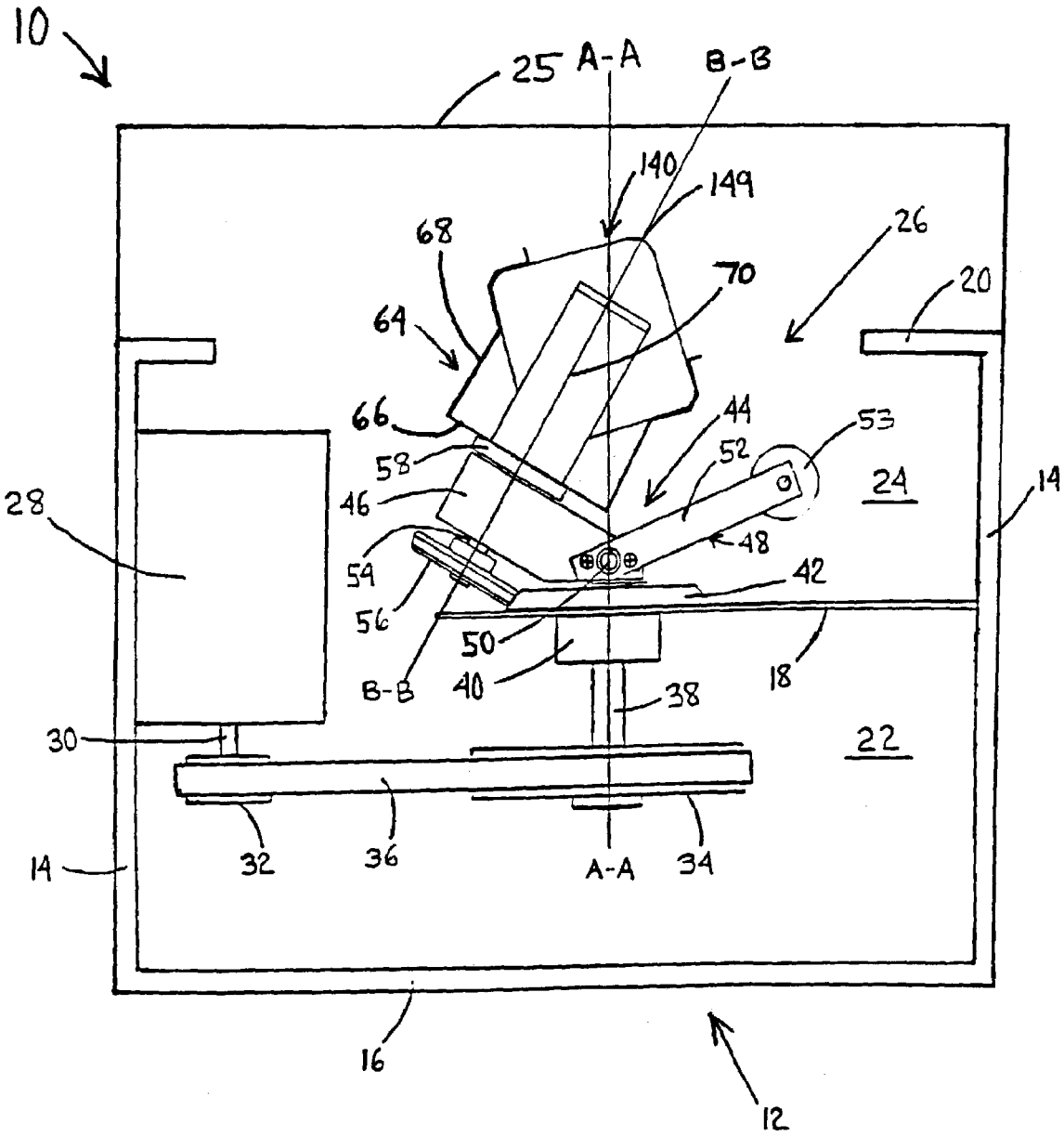
FIG. 1 shows a side view of a mixing apparatus having a cabinet with a portion cut away to better show the interior thereof.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

As used herein, the term "conventional one gallon paint container" shall mean a cylindrical steel container for holding paint, having an interior volume of slightly greater than 1 gallon, a diameter of about 6 9/16 inches and a height of about 7 5/8 inches, and including a bail handle secured to a pair of mounting ears.

Referring now to FIG. 1, there is shown a mixing apparatus 10 embodied in accordance with the present invention. The mixing apparatus 10 is operable to mix a fluid dispersion, such as paint, that is disposed in either a cylindrical container or in a generally square container. For proper operation, the mixing apparatus 10 should be disposed on a substantially horizontal surface, and in the following description, it will be assumed that the mixing apparatus 10 is so disposed.

The mixing apparatus 10 includes a rectangular cabinet 12 having upstanding side walls 14, a bottom wall 16, an access door (not shown), an intermediate wall 18 and an upper wall 20. The intermediate wall 18 divides the cabinet 12 into a lower drive chamber 22 and an upper loading chamber 24. The access door closes an opening (not shown) that provides access to the drive chamber 22. The access door may be hinged to one of the adjacent side walls 14 so as to be pivotable between open and closed positions, or the access door may be removably disposed between the ends of two of the side walls 14. The upper wall 20 has an enlarged circular opening 26 formed therein, which provides access to the loading chamber 24. A hood 25 with a door (not shown) is mounted to the cabinet 12, above the upper wall 20.

An electric motor 28 is mounted toward the rear of the cabinet 12 and extends between the drive chamber 22 and the loading chamber 24. A rotor shaft 30 of the electric motor 28 extends downwardly and is disposed in the drive chamber 22. A motor sprocket 32 with teeth is secured to an end of the rotor shaft 30. The motor sprocket 32 is drivingly connected to a larger diameter drive sprocket 34 by an endless belt 36 having interior ribs. The drive sprocket 34 is secured to a lower end of a vertical drive shaft 38 that extends upwardly through a bearing mount 40 and into the loading chamber 24 through an opening (not shown) in the intermediate wall 18. In the loading chamber 24, the drive shaft 38 extends through a central passage (not shown) in a pedestal 42 that is disposed on an upper side of the intermediate wall 18. An upper end of the drive shaft 38 is secured to a yoke 44 disposed in the loading chamber 24, above the pedestal 42. The bearing mount 40 is secured to the pedestal 42, with the intermediate wall 18 trapped in between. The bearing mount 40 has a plurality of bearings (not shown) disposed therein for rotatably supporting the drive shaft 38.

Figure 2:
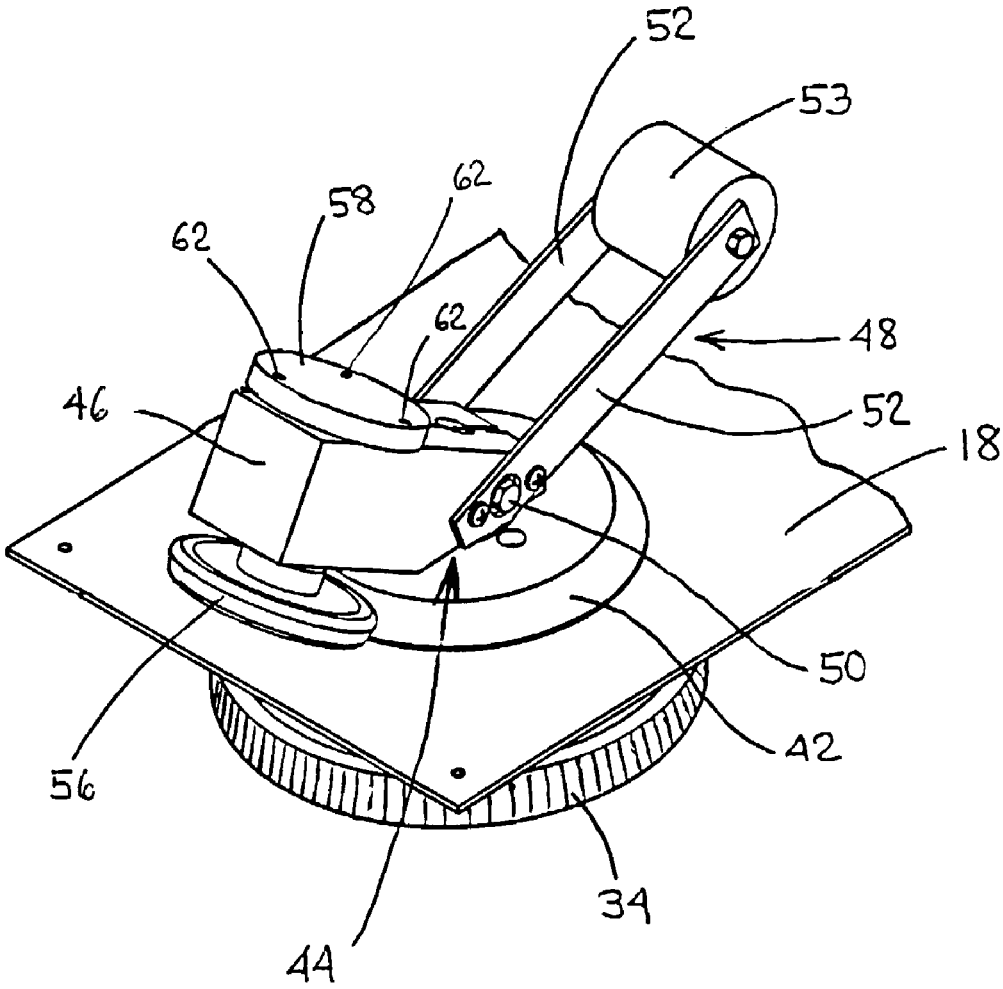
FIG. 2 shows a top perspective view of a portion of the mixing apparatus.

Referring now also to FIG. 2, the yoke 44 includes a mounting arm 46 and a balancing arm 48 secured together at their inner ends by a bolt 50 that also secures the upper end of the drive shaft 38 to the yoke 44. The mounting arm 46 and the balancing arm 48 extend outwardly in opposing lateral directions and extend upwardly at acute angles from the vertical. The balancing arm 48 is bifurcated and includes a pair of spaced-apart elongated plates 52. A cylindrical counterweight 53 is secured between outer ends of the plates 52. The counterweight 53 balances the yoke 44 when a container of a fluid dispersion, such as paint, is mounted to the mounting arm 46, as will be described more fully below.

A mounting shaft (not shown) rotatably extends through a passage (not shown) in the mounting arm 46. Bearings (not shown) may be disposed in the passage to reduce friction between the mounting shaft and the mounting arm 46. A drive wheel 56 is secured to a bottom portion of the mounting shaft, below the mounting arm 46, while a mounting support 58 is secured to an upper portion of the mounting shaft, above the mounting arm 46. The mounting support 58 may circular (as shown) or square. A plurality of threaded bores 62 are formed in the mounting support 58, toward the outer circumfrence thereof.

The drive wheel 56 has a bevelled outer edge that is in frictional engagement with a mating bevelled side surface on the pedestal 42. When the yoke 44 rotates about an axis A—A (shown in FIG. 1) extending through the drive shaft 38 (as will be described more fully below), the drive wheel 56 is moved around the pedestal 42. Since the outer edge of the drive wheel 56 is in engagement with the bevelled surface on the pedestal 42, the drive wheel 56 rotates around an axis B—B (shown in FIG. 1) extending through the mounting shaft (as will be described more fully below). The axis B—B extends upwardly and preferably intersects the axis A—A at an angle of from about 20° to about 40°, more preferably at an angle of about 30°. If the mixing apparatus 10 is disposed on a substantially horizontal surface, the axis A—A extends substantially vertical, i.e., at about 90° from the horizontal.

It should be appreciated that in lieu of the drive wheel 56 and the pedestal 42 being in frictional engagement, the drive wheel 56 and the pedestal 42 may be in positive mechanical engagement through the use of mating gear teeth formed in the edge of the drive wheel 56 and in the side surface of the pedestal 42.

Figure 3:
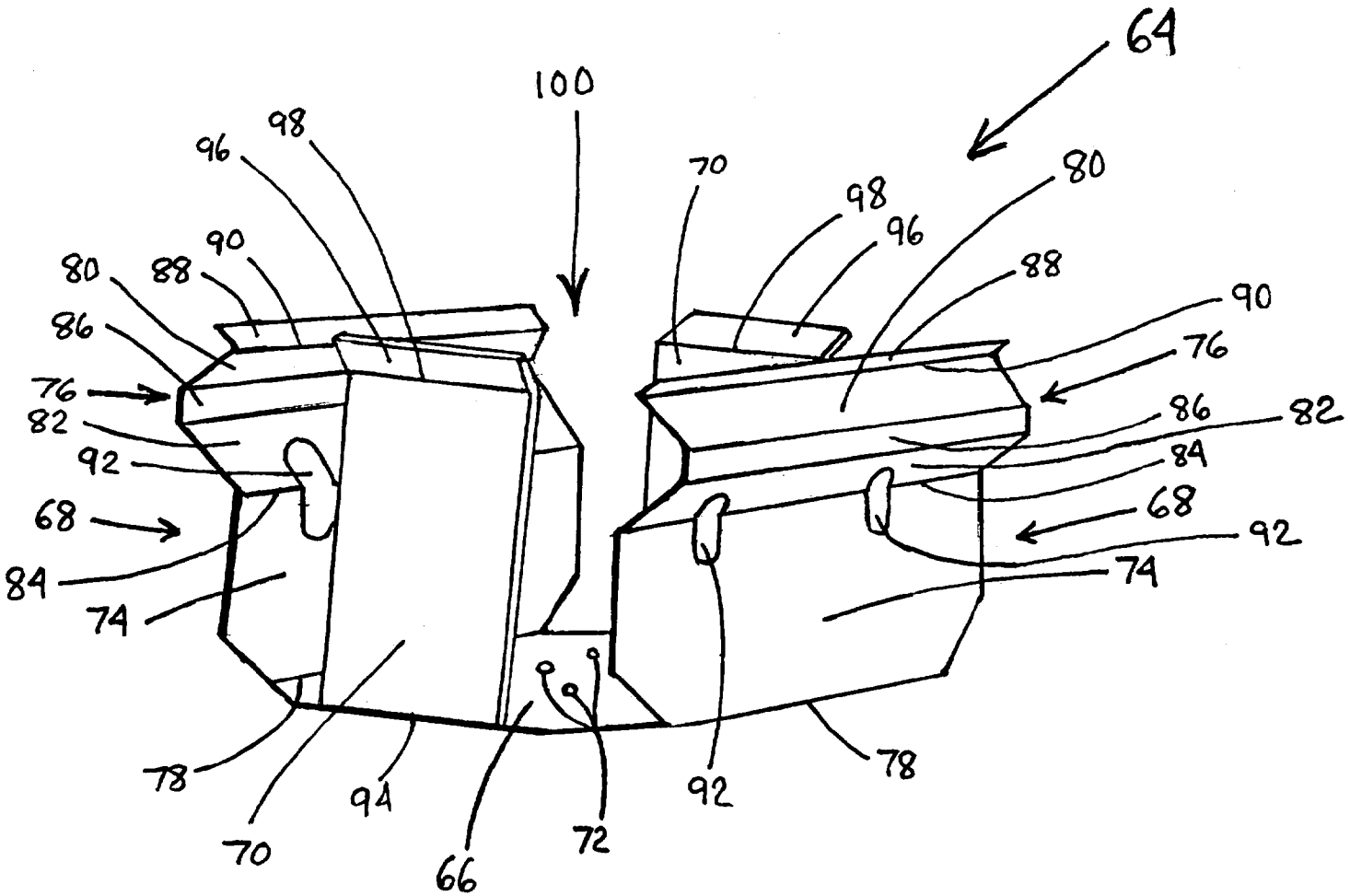
FIG. 3 shows an end perspective view of a cradle for use in the mixing apparatus.

Referring now to FIG. 3 there is shown perspective views of a cradle 64 for holding a container of a fluid dispersion, such as paint. The cradle 64 is composed of rigid metal, preferably steel, and includes a base plate 66, a pair of opposing side walls 68 and a pair of opposing end walls 70. The cradle 64 has a longitudinal axis extending through the end walls 70.

The base plate 66 is generally rectangular with beveled corners. A plurality of mounting holes 72 are formed in the base plate 66, toward the center thereof.

The side walls 68 include bottom portions 74 and top portions 76. The bottom portions 74 are generally rectangular and are joined to the base plate 66 at bottom side bends 78. The bottom portions 74 extend upwardly from the base plate 66 at acute angles, preferably about 87°. In this manner, the bottom portions 74 extend slightly inward, toward the center of the base plate 66. Preferably, end edges of the bottom portions 74 slope inwardly as they approach the base plate 66 so as to form beveled edges.

The top portions 76 of the side walls 68 are generally L-shaped in cross-section and have upper and lower appendages 80, 82. The lower appendages 82 are joined to the bottom portions 74 at first middle side bends 84. The lower appendages 82 are joined to the upper appendages 80 at second middle side bends 86. The upper appendages 80 are positioned perpendicular to the lower appendages 82 and extend inwardly, toward the center of the base plate 66. Top flanges 88 are joined at upper side bends 90 to the upper appendages 80 and extend upwardly and outwardly therefrom.

A pair of elliptical openings 92 is formed in each side wall 68. Each opening 92 extends through the first middle side bend 84 and is located partially in the bottom portion 74 and partially in the lower appendage 82 of the top portion 76.

The end walls 70 are generally rectangular and are joined to the base plate 66 at lower end bends 94. The end walls 70 extend upwardly and slightly inwardly, toward the center of the base plate 66. Top flanges 96 are joined at upper end bends 98 to the end walls 70 and extend upwardly and outwardly therefrom. Side edges of the end walls 70 are spaced inwardly from the side walls 68. Thus, each of the side walls 68 and the end walls 70 is a free standing structure, joined only to the base plate 66. In this manner, the side walls 68 and the end walls 70 can be flexed outwardly.

The top flanges 88 of the side walls 68 and the top flanges 96 of the ends walls 70 define an access opening 100 through which a paint container may be inserted into the cradle 64.

The cradle 64 is preferably constructed such that: (i) the interior lateral distance between the first middle side bends 84 is a small amount less than the diameter of a conventional one gallon paint container, which as set forth above is about 6 9/16 inches; and (ii) the interior lengthwise distance between the lower end bends 94 is sized to snugly accommodate the height of a conventional one gallon paint container; and (iii) the interior lateral distance between the second middle side bends 86 is a small amount less than the hypotenuse of a right triangle having sides equal to the diameter of a conventional one gallon paint container. With these dimensions, the interior length between the upper end bends 98 is a small amount less than the height of a conventional one gallon paint container, since the end walls 70 extend slightly inward.

Figure 4:
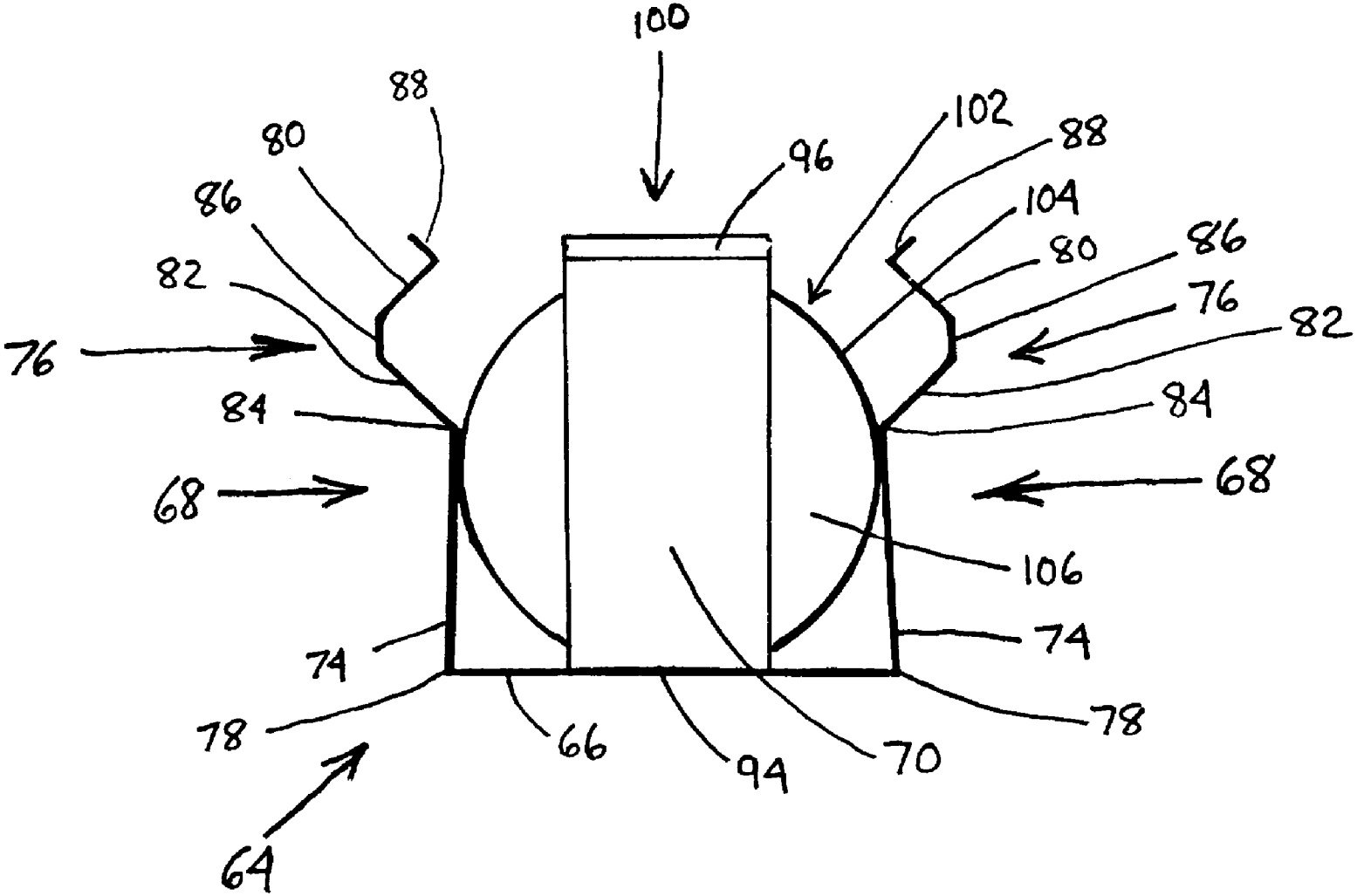
FIG. 4 shows an end view of the cradle with a conventional one gallon paint container disposed therein.

A conventional one gallon paint container, such as paint container 102 (shown in FIG. 4) is inserted into the cradle 64 by placing the paint container 102 on its side, aligning the paint container 102 above the top flanges 88, 96 of the side walls 68 and the end walls 70 of the cradle 64, and positioning the paint container 102 such that a line through the mounting ears is parallel to the base plate 66. The paint container 102 is then pressed downwardly against the top flanges 96 of the end walls 70. Since the top flanges 96 slope upwardly and outwardly, outer surfaces of the top flanges 96 act as cam surfaces to translate the downward force from the paint container 102 into outwardly directed forces that cause the end walls 70 to flex outwardly and permit the paint container 120 to pass through the access opening 100 and enter the cradle 64. As the paint container 102 enters the cradle 64, a cylindrical side wall 104 of the paint container 102 contacts the first middle side bends 84 of the side walls 68, thereby causing the side walls 68 to flex outwardly and permit the mounting ears of the paint container 102 to pass through opposing openings 92 in the side walls 68 and the paint container 102 to be fully disposed in the cradle 64. With the paint container 102 so positioned in the cradle 64 as shown in FIG. 4, the first middle side bends 84 apply inwardly-directed forces against opposing portions of the cylindrical side wall 104 of the paint container 102 and upper portions of the end walls 70 apply inwardly-directed forces against the ends 106 of the paint container 102, thereby causing the paint container 102 to be securely held in the cradle 64.

Figure 5:
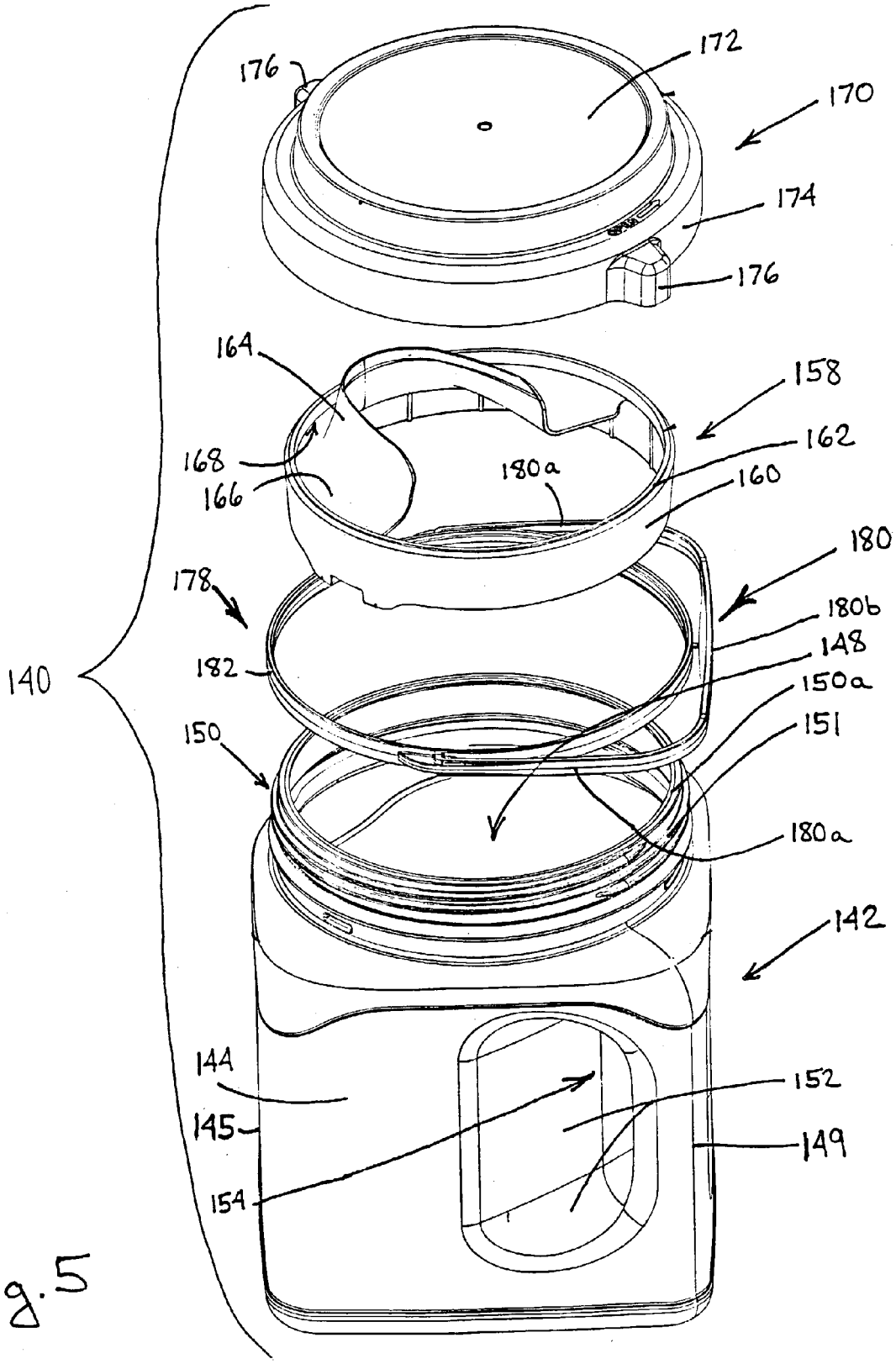
FIG. 5 shows an exploded view of a square plastic paint container.

The cradle 64 is also adapted to hold a square paint container, such as the plastic paint container 140 shown in FIG. 5. The container 140 comprises a plastic body 142 having a generally square shape with generally square side walls 144. The body 142 is preferably blow molded from high density polyethylene. The side walls 144 have a thickness of about 0.06 inches and are joined at two rounded side corners 145, a handle corner 149 and a sloping front corner 147 (shown in FIG. 6). The body 142 also includes a bottom wall 143 (shown in FIG. 6) and atop wall 146 with an enlarged opening formed therein. The top wall 146 and the bottom wall 143 have a thickness of about 0.06 inches. A collar 150 with an external thread 151 is disposed around the opening in the top wall 146 and extends upwardly therefrom. The collar 150 terminates in an upper rim 150*a* defining an access opening 148, which is sized to permit a conventional paint brush to extend therethrough. More specifically, the access opening 148 preferably has a diameter greater than about 4 inches, more preferably greater than about 5 inches.

The body 142 has a plurality of inner walls 152 defining a handle passage 154. A handle 156 is formed at a corner of the body 142 and extends vertically across the handle passage 154. An innermost one of the inner walls 152 that defines the handle passage 154 is disposed laterally inward from the collar 150. In this manner, a portion of the handle passage 154 is disposed laterally inward from the collar 150.

A pouring insert 158 is provided for removable mounting in the access opening 148 of the container 140. The pouring insert 158 comprises an annular mounting ring 160 having a skirt 162 for disposal over the upper rim 150*a* of the container 140. A pour spout 164 is disposed radially inward from the mounting ring 160 and is joined thereto by a curved wall 166. The pour spout 164 is generally semi-circular and extends above the upper rim 150*a*, The apex of the pour spout 164 is spaced about ½ an inch from the upper rim 150*a* when the pouring insert is properly disposed in the access opening 148. The curved wall 166 slopes downwardly as it extends rearwardly, toward the handle 156. The curved wall 166, the mounting ring 160 and the pour spout 164 define a drainage groove 168 that collects paint drips from the pour spout 164 and permits the collected paint to flow back into the container 140.

A tiered lid 170 is provided for closing the access opening 148. The lid 170 comprises a cylindrical top portion 172 joined to a larger cylindrical bottom portion 174. The bottom portion 174 has an internal thread (not shown) for engaging the threads 151 of the collar 150 to threadably secure the lid 170 to the collar 150. A pair of grip tabs 176 extend radially outward from an outside surface of the bottom portion 174.

The width of the container 140 is substantially the same as the diameter of a conventional one gallon paint container, namely about 6⁹⁄₁₆ inches. The height of the container 140, up to the top of the lid 170 (when it is securely threaded to the collar 150) is about 7⅞ inches. The interior volume of the container 140 is slightly greater than 1 gallon.

The container 140 includes a bail handle structure 178 composed of plastic and comprising a bail handle 180 integrally joined at opposing ends to an annular band 182. The handle 180 is generally rectangular and has two legs 180*a* joined to opposing ends of a central member 180*b* so as to be generally perpendicular thereto. Preferably, the band 182 is constructed to be expandable so that the band 182 can be snapped over the collar 150 and trapped under a lowermost turn of the threads 151. The band 182 can be rotated around the collar 150 between a flush position, wherein the legs 180*a* and central member 180*b* are substantially parallel to and flush with the side walls 144 of the body 142, and an extended position, wherein the legs 180*a* and the central member 180*b* are disposed at oblique angles to the side walls 144, thereby forming protruding loops. The bail handle 180 can be flexed to a carrying position, wherein the handle 180 is substantially perpendicular to the band 182.

Figure 6:
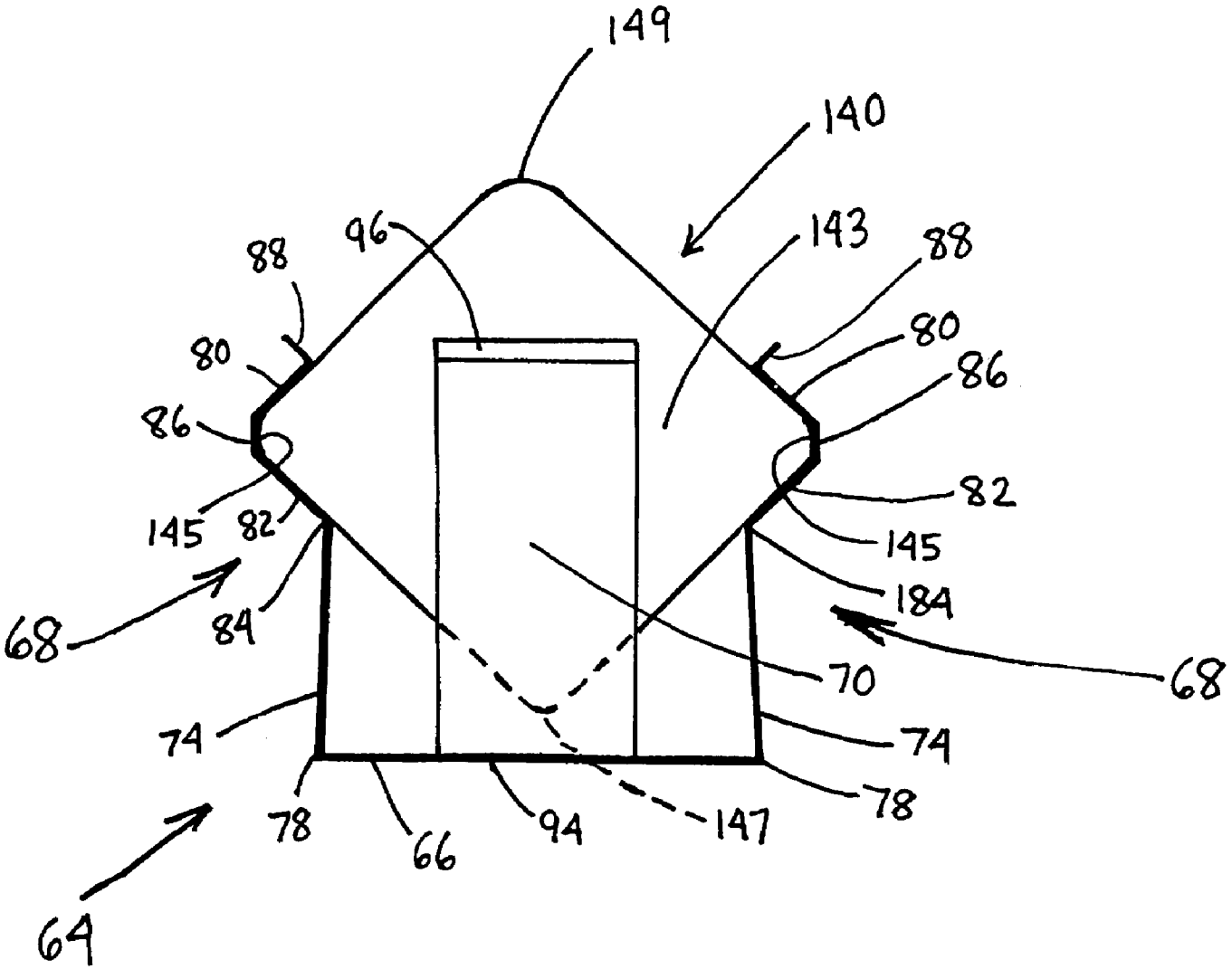
FIG. 6 shows an end view of the cradle with the square plastic paint container disposed therein.

In the following description of the insertion of the container 140 into the cradle 64, it will be assumed, for ease of discussion, that the cradle 64 is positioned such that the base plate 66 is horizontal, as shown in FIG. 6. In actual use, however, the cradle 64 will be positioned such that the base plate 66 is sloping at an angle as shown in FIG. 1.

The container 140 is inserted into the cradle 64 by placing the container 140 on its side, with the handle corner 149 directed vertically upward and the front corner 147 directed vertically downward, and aligning the container 140 above the top flanges 88, 96 of the side walls 68 and the end walls 70 of the cradle 64. The container 140 is then pressed downwardly against the top flanges 88, 96 of the side walls 68 and the end walls 70. Since the top flanges 88, 96 slope upwardly and outwardly, outer surfaces of the top flanges 88, 96 act as cam surfaces to translate the downward force from the container 140 into outwardly directed forces that cause the end walls 70 and the side walls 68 to flex outwardly and permit the container 140 to pass through the access opening 100 and enter the cradle 64. Once the side corners 145 pass the top flanges 88 of the side walls 68, the side walls 68 move back inwardly and trap the side corners 145 in the second middle side bends 86. With the container 140 so positioned in the cradle 64 as shown in FIG. 6, the second middle side bends 86 apply inwardly-directed forces against the side corners 145 of the container 140 and the end walls 70 apply inwardly-directed forces against the lid 170 and the bottom wall 143 of the container 140, thereby causing the container 140 to be securely held in the cradle 64.

Referring back to FIG. 1, the cradle 64 is secured to the mounting support 58 by disposing the cradle 64 on the mounting support 58 such that the mounting holes 72 are aligned with the bores 62 in the mounting support 58. Bolts (not shown) are inserted through the mounting holes 72 and are threaded into the bores 62. With the cradle 64 secured to the mounting support 58 in the foregoing manner, the cradle 64 extends upwardly, through the circular opening 26 in the cabinet 12. The longitudinal axis of the cradle 64 is perpendicular to both the axis B—B and the axis A—A.

As shown in FIG. 1, the container 140 is disposed in the cradle 64 as described above with reference to FIG. 6. The longitudinal axis of the container 140 is disposed perpendicular to both axis A—A and axis B—B. The axis B—B extends through the front corner 147 and the handle corner 149 of the container 140 and divides the handle passage 154 into two generally equal portions. When the electric motor 28 is provided with power, the rotor shaft 30 and, thus, the motor sprocket 32 rotate. The belt 36 transfers the rotation of the motor sprocket 32 to the drive sprocket 34, thereby causing the drive sprocket 34 and, thus, the drive shaft 38 to rotate. The rotation of the drive shaft 38 causes the yoke 44 to rotate about the axis A—A, which, in turn, causes the drive wheel 56 and the mounting support 58 to rotate about the axis B—B. As a result, the cradle 64 and, thus, the container 140 are simultaneously rotated about the axis A—A and the axis B—B, thereby mixing the paint in the paint container 140.

Since the axis B—B divides the handle passage 154 into two generally equal portions, the amount of fluid dispersion in the container 140 that is displaced by the handle passage 154 is generally balanced around the axis B—B. Thus, it is not necessary to insert a counterweight into the handle passage 154 to properly balance the container 140 as it is rotating around the axis B—B (and axis A—A).

The mixing apparatus 10 is very effective in mixing fluid dispersions disposed in a cylindrical or square container having a handle integrally formed in the body thereof. In fact, Applicant has found that the mixing apparatus 10 is significantly more effective in mixing a fluid dispersion disposed in a generally square container, such as the paint container 140, than in a cylindrical container, such as a conventional paint container. This result was surprising and unexpected.

Figure 7:
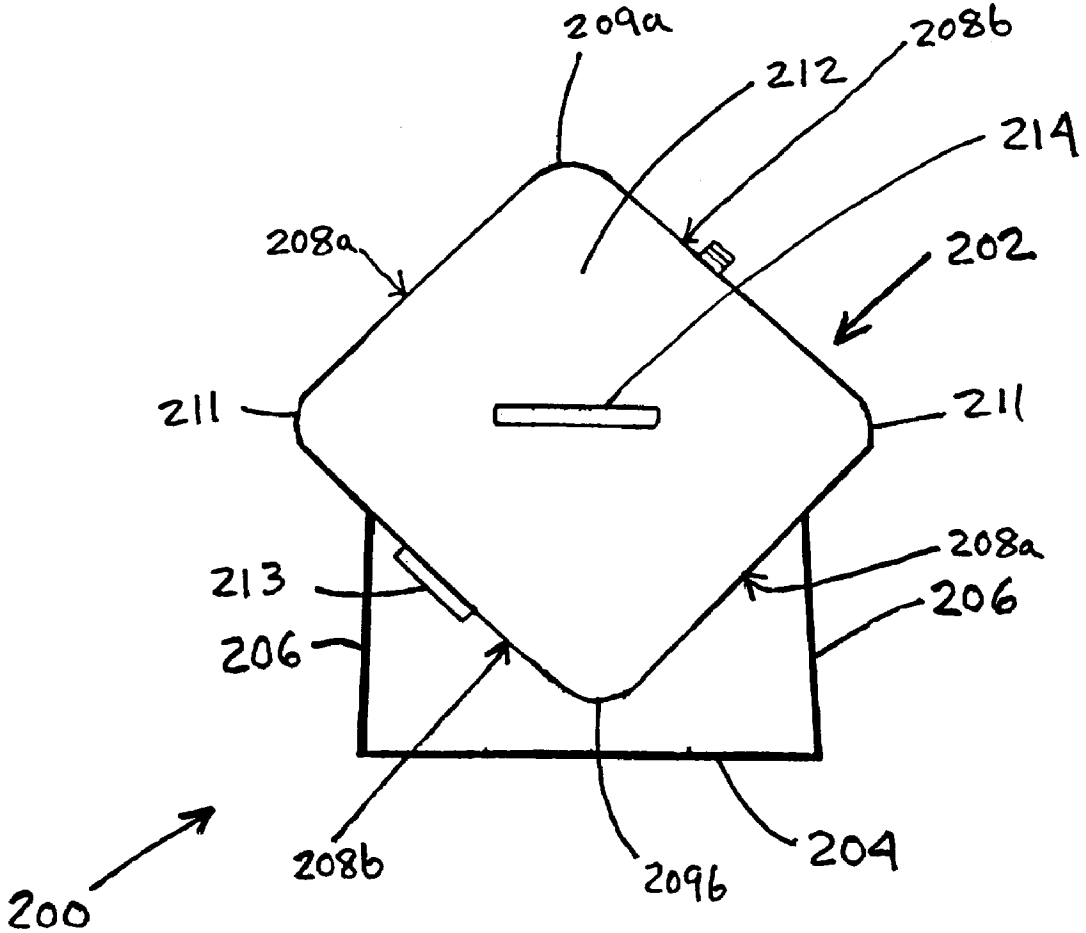
FIG. 7 shows an end view of a housing structure that ray be used in the mixing apparatus in lieu of the cradle, wherein a door of the housing structure is in a closed position.
Figure 8:
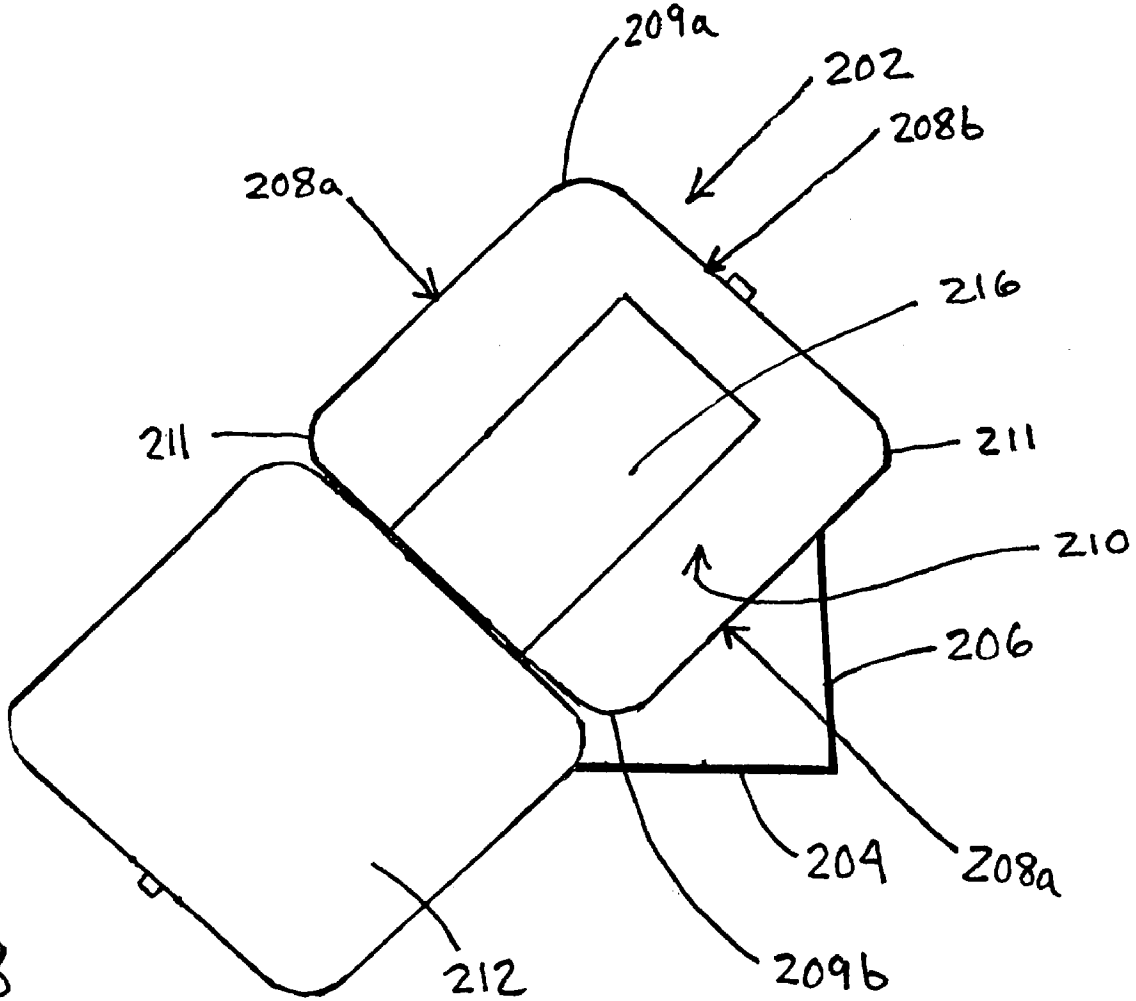
FIG. 8 shows an end view of the housing structure with the door in an open position.
Figure 9:
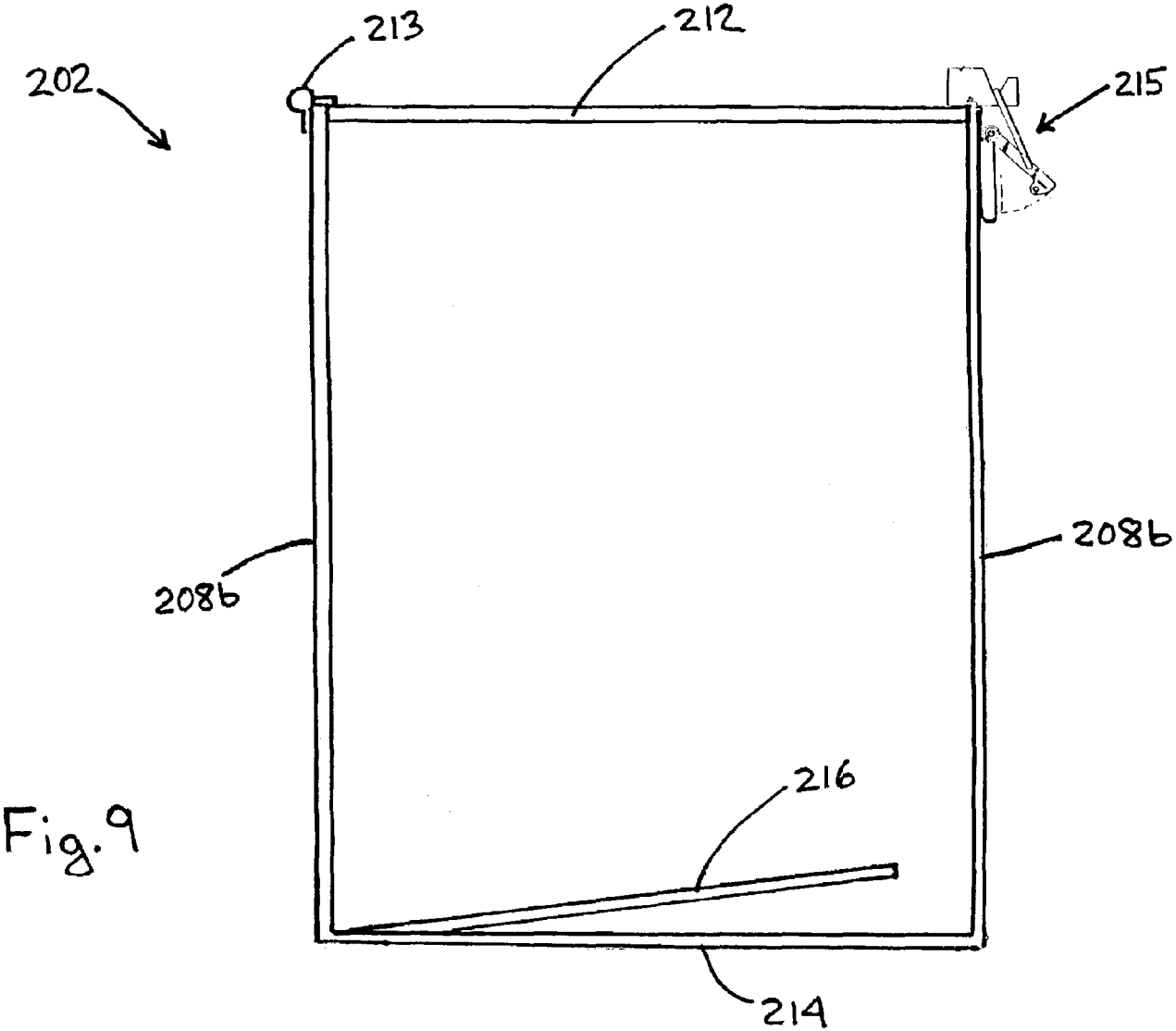
FIG. 9 shows a sectional view of a housing of the housing structure.

Referring now to FIGS. 7–9, there is shown a housing structure 200 that may be used in the mixing apparatus 10 in lieu of the cradle 64. The housing structure 200 includes a housing 202 secured to a base plate 204 by legs 206.

The housing 202 is comprised of a pair of parallel and substantially planar first walls 208*a* and a pair of parallel and substantially planar second walls 208*b*. The first and second walls 208*a,b* are generally rectangular and are arranged such that a line extending between the first walls 208*a* intersects a line extending between the second walls 208*b*. More specifically, the first and second walls 208*a,b* are arranged to provide the housing 202 with a generally square cross-section. Preferably, side edges of the first walls 208*a* are joined to side edges of the second walls 208*b* at rounded top and bottom corners 209*a*, 209*b* and rounded side corners 211. Front edges of the first and second walls 208*b* define a side opening 210, which is closed by a door 212. The door 212 is pivotably connected by a hinge 213 to the housing 202 for movement between a closed position (shown in FIG. 7) and an open position (shown in FIG. 8). The door 212 includes a handle 214. The door 212 is secured shut in the closed position by an overcenter latch 215 (shown in FIG. 9).

The housing 202 is constructed such that the interior width of the housing 202, both in the direction between the first walls 208*a* and in the direction between the second walls 208*b* is sized to snugly accommodate the diameter of a conventional one gallon paint container, which as set forth above is about 6 9/16 inches. In this manner, the housing 202 can accommodate a conventional one gallon paint container and the square paint container 140.

An end plate 214 is secured to rear edges of the first and second walls 208*a*, 208*b*. A spring plate 216 is secured to an inside surface of the end plate 214 and extends laterally and forwardly therefrom.

The housing 202 is constructed such that when the door 212 is in the closed position, the interior lengthwise distance between the free end of the spring plate 216 and an interior surface of the door 212 is a small amount less than the height of a conventional one gallon paint container.

In the following description of the securement of the container 140 in the housing structure 200, it will be assumed, for ease of discussion, that the housing structure 200 is positioned such that the base plate 204 is horizontal, as shown in FIGS. 7 and 8. In actual use, however, the housing structure 200 will be positioned such that the base plate 204 is sloping at an angle.

The paint container 140 may be securely disposed in the housing structure 200 by first opening the door 212 (as shown in FIG. 8), placing the paint container 140 on its side, with the handle corner 149 directed vertically upward and the front corner 147 directed vertically downward (toward the base plate 214) and inserting the paint container 140 into the housing 202 through the side opening 210, with the bottom wall 143 entering the housing 202 first. The door 212 is then pivoted toward the closed position and the overcenter latch 215 is used to apply a longitudinal force against the door 212 so as to press the bottom wall 143 of the paint container 140 against the spring plate 216, thereby deflecting the spring plate 216 toward the end plate 214. The overcenter latch 215 is then moved to a locked position. With the paint container 140 so positioned, the handle corner 149 and the front corner 147 of the paint container 140 are held in the top and bottom corners 209*a*, 209*b* of the housing 202, respectively, and the side corners 145 of the paint container 140 are held in the side corners 211 of the housing 202. In addition, the bottom wall 143 and the lid 170 of the paint container 140 are clamped between the spring plate 216 and the door 212 through the bias of the spring plate 216.

The housing structure 200 is secured to the mounting support 58 by disposing the base plate 204 on the mounting support 58 such that mounting holes (not shown) in the base plate 204 are aligned with the bores 62 in the mounting support 58. Bolts (not shown) are inserted through the mounting holes and are threaded into the bores 62. With the housing structure 200 secured to the mounting support 58 in the foregoing manner, the housing structure 200 extends upwardly, through the circular opening 26 in the cabinet 12. The longitudinal axis of the housing structure 200 is perpendicular to both the axis B—B and the axis A—A.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. Apparatus for mixing a fluid dispersion disposed in a container, said apparatus comprising:

a holding structure for holding the container during the mixing of the fluid dispersion, said holding structure having a longitudinal axis along which the container may be disposed lengthwise, and wherein the holding structure includes (i) a base;

(ii) a first pair of opposing walls extending from the base; and (iii) a second pair of opposing walls extending from the base, wherein the second pair of opposing walls further comprise a lower portion and an upper portion, wherein said lower portion is generally planar and said upper portion is generally L-shaped in cross-section, and comprising at least one upper and at least one lower appendage, said at least one upper appendage extending inwardly;

and wherein said first and second pair of opposing walls at least partially define an interior holding space, and wherein when a cylindrical container is placed in the holding space, the container is at least partially retained by the first pair of opposing walls and at least partially retained by the lower portion of the second pair of opposing walls, and wherein when a non-cylindrical container is placed in the holding space, the container is at least partially retained by the first pair of opposing walls and at least partially retained by the upper portion of the second pair of opposing wails; and an electric motor connected to the holding structure for rotating the holding structure around at least one rotational axis, wherein the rotational axis is disposed perpendicular to the longitudinal axis of the holding structure.

2. The apparatus of claim 1, wherein the electric motor is operable to rotate the holding structure round two rotational axes, each of which is perpendicular to the longitudinal axis of the holding structure.

3. The apparatus of claim 1, wherein the holding structure has an opening through which the container may be inserted into the holding structure, wherein the opening extends perpendicular to the longitudinal axis of the holding structure, thereby permitting the container to be inserted into the holding structure in a direction perpendicular to the longitudinal axis of the holding structure.

4. The apparatus of claim 1, wherein the holding structure has an opening through which the container may be inserted into the holding structure, wherein the opening extends parallel to the longitudinal axis of the holding structure, thereby permitting the container to be inserted into the holding structure in a direction parallel to the longitudinal axis of the holding structure.

5. The apparatus of claim 1, wherein said non-cylindrical container is a generally square container.

6. The apparatus of claim 1, wherein the base is generally rectangular.

7. Apparatus for mixing a fluid dispersion disposed in a container, said apparatus comprising:

a container;

a holding structure for holding the container during the mixing of the fluid dispersion, said holding structure having a longitudinal axis along which the container may be disposed lengthwise, and wherein the holding structure includes (i) a base;

(ii) a first pair of opposing walls extending from the base; and (iii) a second pair of opposing walls extending from the base, wherein the second pair of opposing walls further comprise a lower portion and an upper portion, and wherein said lower portion is generally planar, and wherein said upper portion is generally L-shaped in cross-section, and comprising at least one upper and at least one lower appendage, said at least one upper appendage extending inwardly;

and wherein said first and second pair of opposing walls at least partially define an interior holding space, and an electric motor connected to the holding structure for rotating the holding structure around at least one rotational axis, wherein the rotational axis is disposed perpendicular to the longitudinal axis of the holding structure.

8. The apparatus of claim 7, wherein the container is cylindrical and wherein the container is at least partially retained by the first pair of opposing walls and at least partially retained by the lower portion of the second pair of opposing walls.

9. The apparatus of claim 7, wherein the container is a generally rectangular container comprising side walls which meet at side corners, and wherein the container is at least partially retained by the first pair of opposing walls and at least one side corner of the container is retained by the upper portion of the second pair of opposing walls.

* * * * *

UNITED STATES PATENT AND TRADEMARK OFFICE

CERTIFICATE OF CORRECTION

PATENT NO. : 7,182,505 B2
APPLICATION NO. : 10/435693
DATED : February 27, 2007
INVENTOR(S) : Dwight R. Huckby It is certified that error appears in the above-identified patent and that said Letters Patent is hereby corrected as shown below:

In the specification,

Column 2, Line 1, delete “ray”, and insert --may--.

Column 5, Line 15, delete “atop”, and insert --a top--.

In the claims,

Column 9, Line 4, delete “wails”, and insert --walls--.

Signed and Sealed this
Twenty-first Day of April, 2015

Michelle K. Lee

Michelle K. Lee
*Director of the United States Patent and Trademark Office*